United States Patent [19]

Meyers

[11] 3,982,703

[45] Sept. 28, 1976

[54] MOUNTING ASSEMBLY FOR FOOD WASTE DISPOSER

[75] Inventor: Theodore F. Meyers, Troy, Ohio

[73] Assignee: Hobart Corporation, Troy, Ohio

[22] Filed: June 26, 1974

[21] Appl. No.: 483,456

[52] U.S. Cl. ..... 241/100.5; 285/159; 285/321

[51] Int. Cl.[2] ..... B02B 7/02

[58] Field of Search ..... 285/49, 159, 376, 400, 285/401, 402, 12, 18, 192, 360, 361, 376, 396; 241/100.5, 32.5; 4/189, 190, 187

[56] References Cited

UNITED STATES PATENTS

| | | | |
|---|---|---|---|
| 2,403,194 | 9/1959 | Ewing | 285/159 X |
| 2,761,626 | 9/1946 | Gustaveson | 241/100.5 X |
| 2,819,915 | 1/1958 | Woodson | 285/376 X |
| 2,946,525 | 7/1960 | Thierer | 241/100.5 |
| 3,026,815 | 3/1962 | Jacobs | 285/159 |
| 3,089,654 | 5/1963 | Voudy | 241/100.5 |
| 3,104,400 | 9/1963 | Luntz et al. | 285/376 X |
| 3,154,256 | 11/1964 | Bebinger | 241/100.5 X |
| 3,386,671 | 6/1958 | Turner | 241/100.5 |
| 3,425,637 | 2/1969 | Enright et al. | 241/32.5 |
| 3,768,742 | 10/1973 | Preher et al. | 241/100.5 |

*Primary Examiner*—Dave W. Arola
*Attorney, Agent, or Firm*—Biebel, French & Nauman

[57] ABSTRACT

A simplified mounting and sealing assembly for rapidly attaching a food waste disposer to a sink includes a sink flange which is inserted into the drain opening in the sink and has an elongated neck extending below the sink. An annular pressure plate is received on the flange neck below the sink, and is temporarily supported by bosses or protuberances on the flange while also capturing the flange in the sink opening. An annular groove is formed in the flange neck below the bosses and a snap ring which is held captive in the disposer engages this groove upon lifting the disposer over the neck. The groove and snap ring hold the disposer on the flange so it is free to be rotated for making electrical and drain connections. An annular flange seal is received in the disposer and an annular compression plate rests on the upper surface of this seal. Jack screws extend between this annular compression plate and the pressure plate to lift the annular pressure plate against the bottom of the sink, compress the annular seal and lock the disposer against movement. The jack screws are threaded into the compression plate and force it downwardly against the seal to cause the seal to engage both the neck of the flange and the disposer at the same time that the pressure plate is lifted up against the bottom of the sink. The arrangement is such that extending the jack screws to lift the pressure plate and compress the flange seal does not alter location of the disposer with respect to the sink or previously completed plumbing-electrical connections.

22 Claims, 8 Drawing Figures

MOUNTING ASSEMBLY FOR FOOD WASTE DISPOSER

BACKGROUND OF THE INVENTION

Food waste disposers, particularly for home use, are commonly installed in a sink opening by one person. An important consideration is the speed and ease with which a disposer may be installed.

It has become common practice to suspend or otherwise support the disposer on the sink drain sleeve, or drain flange. Since the disposer is supported on the drain flange, it has been a common necessity first to install the flange in the sink and then lock it onto the sink using jack screws or the like before the disposer itself is installed and attached to the drain flange. Thus, the necessity for installing and locking the drain flange prior to the connection of the disposer makes the subsequent installation of the disposer awkward and often difficult. In many instances, the angular position of the disposer depends upon the orientation of the drain flange, and it may be difficult or at least time consuming to achieve the proper sighting and alignment of the disposer in order to make the plumbing and electrical connections. Thus, prior arrangements have commonly failed to provide full flexibility in the position of the disposer with respect to the sink drain flange prior to the final fastening and tightening on the flange. At times, these installations are one of trial and error, since the installer must first surmise as to whether a selected drain flange position will assure that the disposer, after its installation, will be properly lined up so that the drain and electrical connections can be made.

Another problem inherent in the installation of waste food disposers concerns the necessity of making a full seal of the drain flange with the sink and making a full seal of the disposer to the drain flange. Commonly, these seals are effected in separate tightening, fastening, or clamping operations.

A particular problem in the installation of food waste disposers resides in the fact that they are usually installed by one person, and the installations are normally made under a sink where the work space is already limited and cramped. Thus, one particular difficulty resides in the lack of freedom to rotate or turn the disposer into any position while it is supported on the sink flange. In other instances, it may be difficult or not possible to turn the sink flange separately from turning the disposer, so that trademark information or operating instructions which may be carried on the exposed flared upper surface of the sink flange may be properly aligned.

One prior arrangement which simplified disposer installations is disclosed in the U.S. patent of Thierer U.S. Pat. No. 2,946,525 of 1960, now assigned to the same assignee as this application. In Thierer, a mounting ring was secured to the heck portion of the drain flange and held in place by a retainer or snap ring after the flange had been inserted in the sink opening. This mounting ring was formed with a series of key-hole-shaped slots and the disposer was provided with headed hanger screws which fit into the slots so that when the disposer was rotated with respect to the mounting ring, these hanger screws would slide into the slots and thus support the weight of the disposer for further installation and adjustment. These hanger screws were individually tightened once the disposer was connected. The mounting ring was also provided with jack screws which were turned so as to urge a pressure washer upwardly against the sink seal and lock the flange on the sink. As a practical matter, it was necessary to have the drain flange at least fairly well secured in place by use of these jack screws prior to placing the disposer into position and turning it in the key-hole-shaped slots, otherwise the flange would turn instead. Further, although the entire unit could be rotated, as a practical matter, the installer had to be careful that he did not inadvertently bring the disposer around to where the headed hanger screws lined up with the access holes, otherwise the disposer would come free of the retainer ring. Furthermore, the final tightening of the hanger screws could alter the location of the disposer by an amount sufficient to disturb the plumbing connections where they were short or rigid in nature.

SUMMARY OF THE INVENTION

The present invention is directed to the further simplification of installing disposers in sinks over that shown in the prior art Thierer patent. In one aspect of the invention, a fastenerless arrangement is provided by which a sink flange is temporarily secured in assembled relation to the sink, such as by a bayonet type of retainer. With the sink flange so secured, the disposer can be lifted, engaged with and supported from the neck of the flange. Thereafter, the disposer may be freely rotated on the sink flange so that its electrical and plumbing connections can be made. Compression means include jack screws threaded in a portion of the mounting apparatus which engage the sink flange retainer, lift the retainer upwardly, and compress the gaskets between the sink and the sink flange. The compression jack screws also operate against a compression plate to compress a seal between the sink flange and the throat of the disposer.

Assembly of the disposer of the present invention into a sink drain opening is substantially simplified in that the pressure ring or washer on the sink flange is used to support the flange in temporary location in the drain opening so that the installer can simply lift the disposer into telescopic relation with the sink flange from under the sink. Upon engagement with the flange, the disposer becomes self-holding and attached to the flange, and yet both the disposer and the flange are free to be rotated for alignment and connection purposes. Thereafter, in the preferred embodiment, only two jack bolts or jack screws are operated, simultaneously locking and sealing the sink flange to the disposer itself while tightening the disposer so that it cannot twist or rotate with relation to its position on the sink.

In the accomplishment of the aims of this invention, a slotted annular pressure washer cooperates with detents or bosses on the sink flange neck for capturing the sink flange in its temporary position. The disposer support incorporates a wire snap ring which is received in an annular groove formed in the neck of the sink flange below the bosses. A ring retainer or collar on the disposer mouthpiece or inlet is formed with a flared inside ring-receiving or capturing surface. When the disposer is pushed upwardly into telescoping relation on the neck of the sink flange and the snap ring engages the groove, the weight of the disposer may thereafter rest on the ring, in that the ring retainer prevents the ring from expanding, and effectively captures it within the neck groove. A portion of the snap ring is brought transversely out of a slot in the retainer housing or collar and is exposed so that, by lifting the weight of the disposer and pushing the ring laterally by grasping its exposed end, the disposer can be released from the flange neck. The opposite end of the ring is also brought transversely out of the retainer housing slot for a short distance to provide a firm anchor point for the snap ring.

The ring retainer mentioned above is assembled to the disposer housing and is held by a series of shouldered cap screws threaded into a radial flange formed on the neck or mouthpiece of the disposer. The compression plate is disposed for limited movement between the ring retainer or collar and the disposer neck and bears the disposer seal. This seal is of annular, generally wedge-shaped cross section which is received within the neck of the disposer. The seal compression plate is somewhat loosely fitted between the ring retainer and the neck and is piloted but not threaded on the same shouldered screws which retain the ring retainer. Rivets or riveted studs could be employed as a cost savings measure in lieu of shouldered bolts, however the use of removable threaded fastenings to mount the ring retainer provides a secondary or last resort method for separating a mounted disposer from a sink flange in the event corrosion or other deterioration should occur over a long period of disposer use.

The gasket end seal tightening means include jack screws which are threaded into the pressure plate. The upper ends of the jack screws engage the annular pressure plate on the neck of the sink flange. This is the same plate which provided temporary support for the sink flange and permitted the disposer to be telescoped over the flange neck prior to snap ring engagement. Turning the jack screws has the dual effect of pushing the annular plate upward away from the sink flange protuberances and against the bottom of the sink while at the same time forcing the compression plate on the disposer downwardly into compressing engagement with the annular seal in the neck of the disposer to urge the seal tightly against the neck of the sink flange. Since the disposer is firmly locked on the neck of the flange by the snap ring and ring retainer, the downward force of the jack screws causes the sink flange itself to be brought downwardly into sealing engagement with the sink. At the same time, the disposer is sealed with the sink, it is fixed against rotation and supported on the sink for use.

In disassembly, the jack screws are loosened, permitting the disposer to be raised and the snap ring to be manually opened; this allows the disposer to slip down off of the neck of the sink flange. Therefore, in the preferred embodiment, only a single operating mechanism, comprising a pair of jack screws, is required to assemble or disassemble the disposer on the sink; this accordingly substantially reduces the time required to assemble or disassemble the disposer.

The present invention also includes an improved stainless steel sink flange for mounting either a continuous or a batch type disposer. One of the improvements in this flange enables it to be used with either a thin sheet-metal sink or a thicker cast-iron sink. A second improvement in the flange provides an exterior flange-body surface which is capable of camming or dilating resilient members contained in the mouth of the disposer during telescoping of the disposer onto the flange while providing an inside ledge for receiving a stopper or a rubber splash shield. An additional improvement in the flange provides it with a sanitary skirt which reduces the opportunity for liquids and other waste products to become trapped in crevices between the flange and the disposer.

One of the advantages of the present arrangement is that the installation can readily be accomplished by a single installer working primarily from beneath the sink. Once the sink flange is dropped into place, the other operations may be performed from below. When the disposer is brought up onto the sink flange, there is no need to hold the flange in position from the top since it is captured by the pressure washer under the sink. Moreover, there is also no need to hold the pressure washer in position on the bottom of the sink flange since it is captured and prevented from falling by the protuberances or detents on the neck of the flange; thus once engaged, the sink flange and the pressure washer mutually captured each other and prevent their displacement from the desired mounting location.

It is accordingly an important object of this invention to provide a simplified arrangement and method for installing a disposer into a sink.

A further object of the invention is to provide a disposer in which the tightening of the seals both between the sink flange and the disposer and between the sink and the sink flange is accomplished at the same time by a single sequence of steps.

A further object of the invention is to provide an improved sink flange for use with a disposer.

A further object of the invention is the provision of a disposer having assembled thereto a snap ring and a ring retainer which automatically engages within a groove formed on the neck of a sink flange and provides support for the disposer while permitting the disposer to be turned and rotated in the connection of the plumbing.

A still further object of the invention is the provision of an improved sink flange for use with a disposer which incorporates provision by means of which it is temporarily retained within either a stainless steel or cast iron sink opening, and which is adapted for receiving the stoppers of either a batch type disposer or a continuous type of disposer.

These and other objects and advantages of the invention will be apparent from the following description, the accompanying drawings, and the appended claims.

DESCRIPTION OF THE PREFERRED EMBODIMENT

Figure 1:
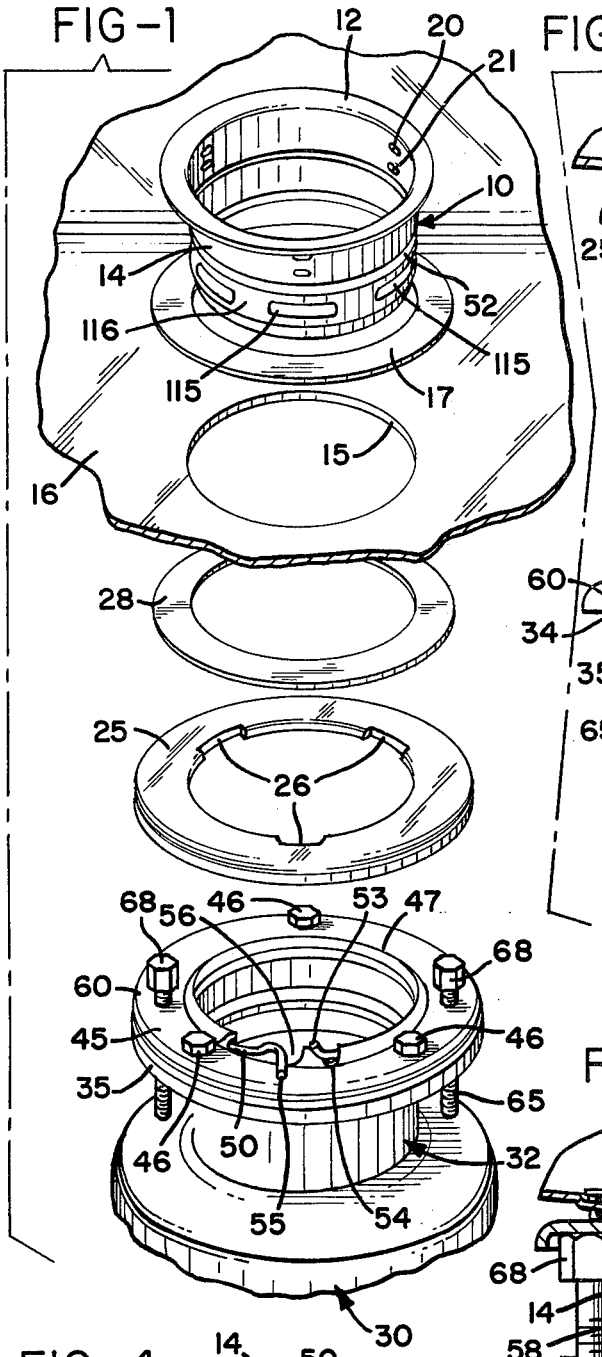
FIG. 1 is an exploded view showing the manner of assembling the sink flange in a sink, and showing some of the details of the disposer.
Figure 2:
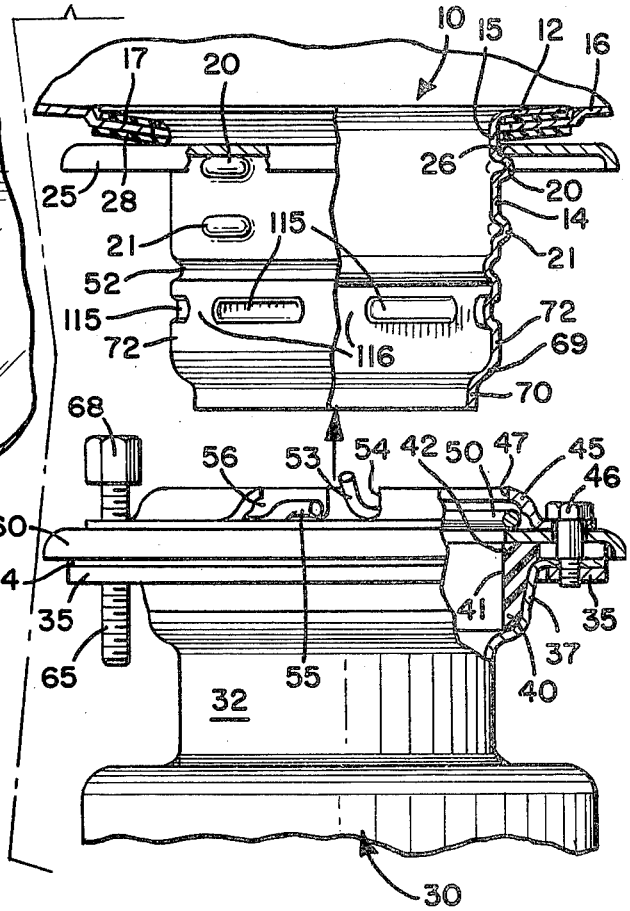
FIG. 2 is a partially broken away exploded view showing the sink flange captured on a sheet metal sink and showing the disposer just prior to being assembled on the neck of the sink flange.
Figure 3:
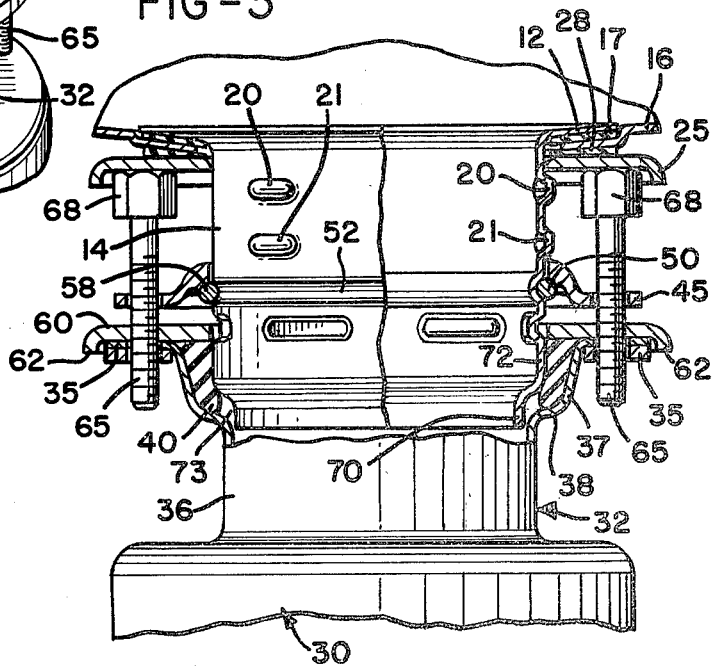
FIG. 3 is a section through the disposer after having been assembled on the sink flange and the jack screws tightened.
Figure 5:
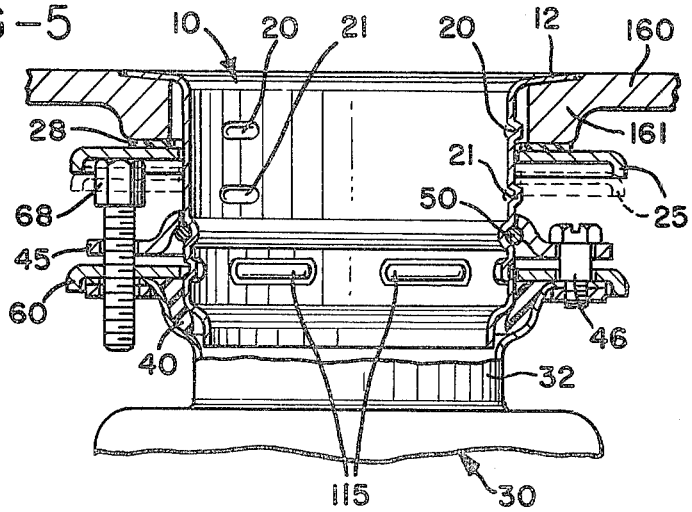
FIG. 5 is a sectional view showing the sink flange as applied to a cast iron sink with disposer attached.

Referring to the figures of the drawing which illustrate a preferred embodiment of the invention, a stainless steel drain sleeve or sink flange is illustrated generally at 10 in FIGS. 1 and 2. The sink flange has an outwardly flared or flanged top 12 and a depending sleeve or neck 14 which is adapted to extend through an opening 15 formed in the bottom of a sink 16. The sink flange 10 is shown in FIGS. 1–3 as being applied to a sheet metal sink, such as a stainless steel sink. As shown in FIGS. 1 and 2 a ring gasket 17 may be positioned between the flared top 12 and the sink 16. In alternate installation arrangements the ring gasket 17 may be replaced with a quantity of sealant material such as plumbing putty or silicone rubber. These sealant materials are especially useful where the opening 15 is itself flared, as in frequently true in cast iron sinks., as shown in FIG. 5.

Means for temporarily capturing the sink flange 10 in the sink 16 includes a plurality of protuberances or bosses 20 or 21 which are formed on the neck 14 of the sink flange in spaced relation to the flared top 12. Two sets 20 and 21 of three bosses are shown in the drawings. These bosses are dimpled or pressed outwardly at approximate 120° intervals around the neck 14 with the two sets of bosses separated axially along the flange sleeve. The set of bosses 20 closest to the flared top 12 of the flange 10 is intended for use with thin stainless steel or sheet metal sinks as shown. The additional set of bosses 21 are provided for use with a thicker sink which is made from such material as cast iron as shown in FIG. 5. Obviously, either the set of bosses 20 or the set 21 can be omitted if desired.

The temporary flange support means includes an annular retainer or pressure plate 25 having an inside diameter which will permit it to be slipped up over the neck 14 of the flange but which will not permit it to pass by the bosses 20 and 21. A plurality of clearance openings, slots, or cutouts 26 are formed in the inside circumference of the plate 25 at the same 120° spacing as the bosses and may be aligned with the bosses 20 or 21 to permit the plate 25 to be assembled over the bosses. The plate may then be rotated and thus keyed or held in place by resting on the upper surfaces of one of the sets of bosses. The bosses 20 and 21 and the cutouts 26 combine to form cooperating interlock means engageable upon rotation of the plate 25 while leaving the plate free for unrestricted movement upwardly against the sink bottom. The combination of the bosses 20 or 21 with the cooperating pressure plate 25 prevent the sink flange from being forced upwardly through the sink opening 15 by the act of engaging the disposer 30 with the flange.

An annular gasket 28 of elastomeric material may be placed between the pressure plate 25 and the sink 16 if desired. The gasket 28 serves primarily to distribute forces exerted by the pressure plate 25 evenly over the area of the sink surrounding the opening 15.

The food disposer 30 of this invention is particularly adapted to be used for the sink flange 10 and is shown as being provided with an inlet or a mouthpiece 32. The mouthpiece 32 is terminated in a flared upper end in the form or a radial portion 34. A reinforcing ring 35 is attached beneath the flared upper end 34 to provide rigidity and also to provide for the threaded engagement of shoulder bolts, described below. The flared upper end 34 is joined with the tubular neck portion 36 by means of an intermediate, inwardly-tapered wall 37 and a bottom, inwardly extending ledge 38. The wall 37 is shown as being formed with a slight taper in the order of 5°–20° and receives therein an elastomeric sealing gasket 40 which is generally wedge-shaped in cross section. As shown in FIG. 2, the gasket 40 has an outer tapered surface conforming generally to the taper of the wall 37 and is formed with a cylindrical inside surface 41. The inside surface 41 is such as to permit the gasket 40 to be received telescopically over the lower edge of the sink flange without undue interference. In the relaxed state of the gasket 40, it extends somewhat above the level of the flared end 34, as indicated at 42 in FIG. 2. The gasket 40 is formed of a relatively soft elastomeric sealing material, and it has been found that neoprene or buta-N having a Shore A durometer reading of about 35 is satisfactory.

A snap ring retainer assembly mounted on the disposer 30 includes an annular ring retainer or collar 45. The collar 45 is secured to the radial flange 34 on the disposer housing by a series of three shoulder bolts 46 as shown in FIGS. 1 and 2. The bolts 46 are threaded into the flange 34 and are also threaded into the reinforcing rings 35. The retainer 45 is formed with a central opening 47 which has a diameter slightly greater than the outside diameter of the neck 14, thus permitting the collar 45 to be placed over the neck 14 when the disposer is assembled on the sink flange.

The retainer 45 captures a loosely-held snap ring 50. The ring 50 is preferably formed of spring wire material with an inside diameter in the relaxed state which is slightly less than the outside diameter of the neck and with an outside diameter which is greater than that of the opening 47. The neck 14 of the sink flange is provided with an annular groove 52 which is axially spaced below the lower set of bosses 21. The groove 52 is proportioned to receive the snap ring partially therein when the disposer is assembled. One free end 53 of the ring 50 is extended transversely outwardly through a small access cutout or opening 54 which is formed in one side of the retainer 45. The cutout 54 thus serves to capture the end 53 of the ring 50. The opposite end of the ring 50 is terminated in a radially outwardly turned end 55 extending through a somewhat wider access opening 56 in the retainer 45 than the capturing opening 54. The outwardly turned end 55 provides means by which the ring 50 can be gripped and spread open within the retainer 45 for disassembly of the disposer from the neck 14.

The retainer 45 is formed with a flared internal surface defining an upper inside curved ring-capturing surface 58 which is designed to conform closely to the outer surface of the ring 50 when the ring is received within the groove 52 and thus prevents the ring 50 from expanding and leaving this groove once it is snapped in place in the groove. The retainer 45 also provides a certain amount of axial and radial space at 59 within which the ring 50 may freely expand during assembly and disassembly of the disposer on the neck 14.

An annular, generally radially flat compression plate 60 is assembled on the disposer housing between the ring retainer 45 and the radially flared upper end 34 of the disposer inlet throat. The plate is piloted for limited vertical movement on the shoulder bolts 46. It is formed with a central opening corresponding in diameter to the opening 47 formed in the retainer 45 so that it also may be readily assembled over the neck 14 and is also formed with an annular downwardly-turned edge 62 which overlies the flared end 34. The lower surface of the plate 60 is in flat abutment with the extended and exposed upper portion of the seal 40, and in the relaxed position, the seal 40 holds the plate 60 as well as the retainer 45 in a raised position substantially against the lower surfaces of the heads of the shoulder bolts 46.

The compression plate 60 is threaded to receive a pair of elongated jack screws 65. These screws extend through clearance openings formed in both the retainer 45 and the radial flange 34 and the reinforcing ring 35, as shown in the enlarged view of FIG. 4. The heads of the screws 65 are provided with a hex 68 for the convenience of attaching a wrench. The heads 68 are proportioned to bear against the lower surface of the pressure plate 25 when they are in raised positions as shown in FIG. 3. The jack screws 65 may thus be considered to be adjustable compression means which direct an upward force against the plate 25 and simultaneously direct a seal compressing downward force against the seal 40.

Figure 4:
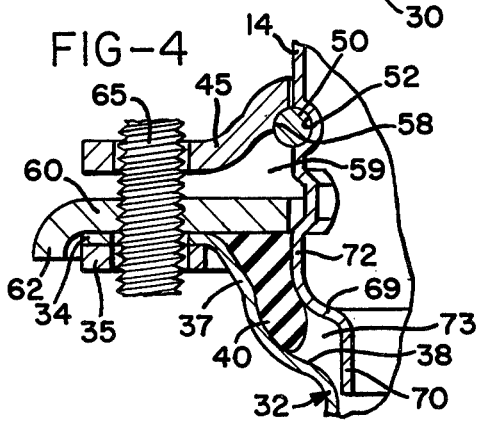
FIG. 4 is an enlarged fragmentary section of a portion of FIG. 3 showing the manner in which the disposer is clamped and sealed to the sink flange.

The lowermost end of the neck 14 is provided with an inwardly flared portion 69 terminating in a downwardly extending skirt 70 of rather short axial dimensions. When the parts are assembled, the skirt 70 extends slightly into the neck 32 and forms a close fit therein, as shown in FIG. 4. The sink flange 14 defines an annular sealing land 72 immediately above the flared portion 69 and in the assembled position, this sealing land is engaged by the inner circumference 41 of the seal 40.

In the assembly of the disposer 30 to the drain flange 10 in a stainless sink 16, the drain flange 10 is first inserted from the top in the opening 15 with the upper gasket 17 thereon. The installer will then place a second gasket 28 up from the bottom of the flange 14 and will loosely assemble the pressure plate 25 by raising it up over the neck 14 with the slots 26 in alignment with the bosses 20 and 21 and will then rotate the plate so that it rests on the upper set of bosses 20. At this time, neither gasket 17 or 28 is under compression, but the sink flange 10 is captured and is prevented from moving upwardly in relation to the sink and the plate 25 is captured and prevented from falling downwardly off of the flange.

The disposer is pre-assembled with the retainer 45 loosely arresting the snap ring 50 and the seal in the flange upper end 34. The shoulder bolts 46 are drawn so that the retainer 45 and the compression plate 60 are retained, as shown in FIG. 2.

The installer now lifts the disposer up so that the neck 14 is received within the throat 32 of the disposer. During this lifting the smaller diameter skirt 70 of the flange 10 acts to guide the neck of the flange smoothly through the snap ring 50 and the seal 40. The inwardly flared portion 69 of the flange assists in this lifting operation by providing a smooth camming surface which expands or dilates both the snap ring 50 and the seal 40 as these members move upward on the flange neck.

The installer continues lifting until the ring 50 drops into the groove 52. When the installer then lowers the disposer, the ring 50 becomes captured and cannot expand out of the groove 52 by reason of its engagement with the inside surface 58 of the retainer 45. The disposer 30 is now self-held and suspended on the sink flange and may be freely turned so that the electrical and plumbing connections can be made. After these are made it is now only necessary to turn the jack screws 65 so that the heads 68 will bear against the pressure plate 25. This causes the plate 25 to be pushed upwardly into sealing engagement with the ring 28 and the sink 16. At the same time, the jack screws 65 bear downwardly on the compression plate 60 and the seal 40, causing the seal to firmly engage the adjacent outside surface of the neck 14.

The downward movement of the compression plate 60 against the seal 40 continues until the plate 60 is in flat metal-to-metal engagement with the adjacent upper surface of the flange 34, as shown in FIG. 4. A controlled compressive force is thus applied to the seal 40 causing it to be firmly compressed about the land 72 and into the space 73 between the flange neck and the disposer mouth opening. The close fit of the skirt 70 with the neck 32, and the air lock effected between these parts by the seal 40 adequately prevents liquids and waste material from entering and becoming trapped in the space 73. Once the jack screws 65 have been brought into play in the manner described, the installation is completed.

It is significant to note that turning the jack screws 65 to push the pressure plate 25 upward and the compression plate 60 downward does not change the location of the disposer with respect to the sink so that the final tightening and sealing of the disposer does not disturb the disposer drain connection, a dishwasher drain inlet connection to the disposer (not shown) or the electrical wiring and its conduit. These connections can be made permanently prior to the final tightening and sealing of the disposer when the present mounting arrangement is employed.

It is of course desirable that the force required to satisfactorily compress and seal the sink to the flange gasket 17 be reasonably the same as the force required to compress the seal 40 and bring the plate 60 down flat against the flange 34. This condition can be achieved by appropriate selection of physical dimensions and composition material for the two gaskets. Neoprene rubber or Buna rubber have been found to be satisfactory gasket materials. Removal of the disposer merely requires the reversal of the tightening procedure and relaxing the pressure of the jack screws 65 followed by grasping the free end 55 of the snap ring 50 to expand it out of the groove 52. The disposer is then free to slide down off of the neck 14. Removal can alternatively be accomplished by loosening the shoulder bolts 46. As shown in FIGS. 2 and 3, the heads of both the shoulder bolts 46 and the jack screws 68 are readily accessible when the disposer is mounted.

The adjustability of the sink flange up to the time of final disposer locking in the present mounting arrangement is also found to provide for a neat and aesthetically appealing disposer installation since it allows the installer to locate the sink flange in a position in the sink opening which is optimum for covering any marred surfaces remaining from a previous disposer or sink flange installation. This adjustability of the flange up to the last possible moment in the installation also permits the installer to adjust the position of the flange and any printed material located on the flared portion of the flange just prior to locking the entire structure in position.

It is of course possible to employ alternate gripping means in lieu of the snap ring 50 and the annular groove 52 for engaging and suspending the disposer from the sink flange 10. One such alternate gripping means for example could employ gravity biased balls (ball bearings) which are held captured in the disposer or the sink flange and which seat in tapered races in the opposite member to support the disposer from the sink flange.

As previously mentioned, the drain flange 10 of this invention is also particularly adapted for use with cast iron type sinks, such as where the hub area at which the cast iron is poured has substantial thickness. FIG. 5 illustrates the invention as applied to such a sink 160 which has a sink opening formed in the relatively thick hub area 161 providing a wall dimension of substantial axial thickness in the order of one-half to one inch. For this purpose, the lowermost bosses 21 are used for temporarily retaining the flange 10 within the sink opening, the pressure plate 25 being shown in FIG. 5 in broken lines in its temporary position where it has captured the flange within the sink opening. In this condition, the upper bosses 20 are substantially received within the axial thickness or dimensions of the sink hub 161 and thus do not interfere with the forming of a compression seal and the fixing of the disposer to the sink, as described above. In this embodiment, only the lower gasket 28 is employed, plumber's putty having been substituted for the upper gasket 17, permitting the flared top 12 to be received within the conventional annular recess formed within the hub 161 for receiving a drain or sink flange.

Figure 6:
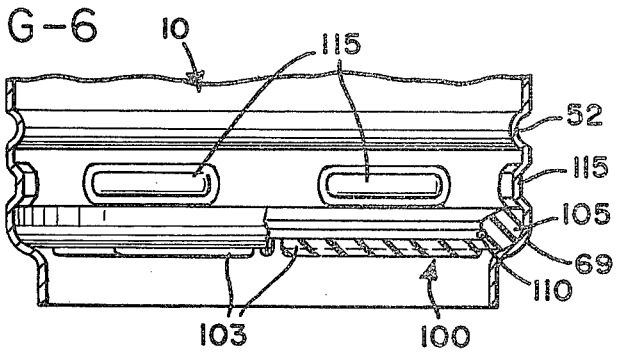
FIG. 6 is a fragmentary enlarged section through the lower portion of the sink flange showing the splash shield installed.
Figure 7:
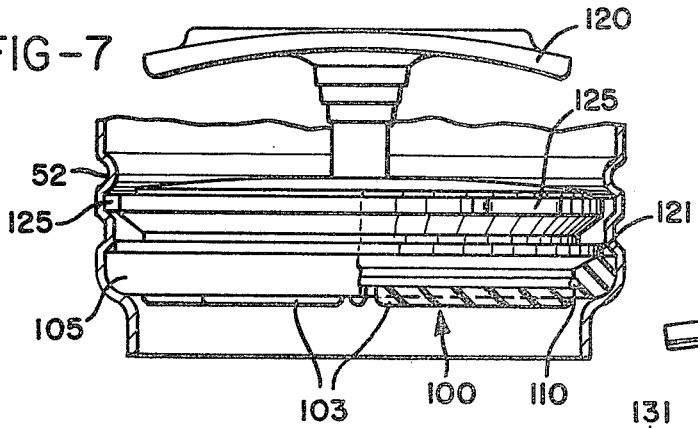
FIG. 7 is a section similar to FIG. 6 showing a sink stopper in place and seated on the splash shield, the stopper being for the continuous type flow disposer.

It has previously been mentioned that the drain flange of this invention permits the connection of either batch type or continuous type disposers. When a continuous type disposer is used, it is possible to operate the disposer with the stopper removed, although this practice is not preferred. Thus, in these disposers, a splash shield indicated generally at 100 is commonly employed. The shield 100 is formed with an annular body 105 which is molded to conform closely to the inner surface of the inwardly flared portion 69, as shown in FIG. 6. A series of inwardly extended V-shaped flaps 103 permit waste food and water to pass into the disposer. A wire ring 110 is preferably received with a conforming groove at the inside circumference of the body 105 to add strength and stability to the splash shield, to prevent it from being inadvertently collapsed and pushed down into the disposer when waste food particles are dropped or pushed through the sink flange into the disposer.

Means on the drain flange for retaining the splash shield in its seated position includes a plurality of interrupted or arcuately spaced indentations 115 which define therebetween outer smooth portions 116. The indentions are thus arcuately spaced about the flange immediately above the sealing land region 72 and immediately above the splash shield body 105 and form, in effect, a series of arcuate retainers for the splash shield 100. The purpose of the intermediate portions 116 is to guide the snap ring 50 past the indentations 115 so that the snap ring will be received only in the annular groove 52 spaced axially above the indentations 115.

In the continuous operating type of disposer, a drain stopper 120 is provided which has a lower annular lip 121 adapted to rest directly on the upper surface of the shield body 105 to provide a drain seat so that the sink may be filled with water. The stopper 120 is further provided with a series of three arcuately spaced flexible ears 125 which have a diameter greater than that of the lip 121. In the seated position, these flexible ears are located and retained just under the groove 52. When it is desired to put the stopper in the drain flange but not to seat the stopper in order to run water past the stopper and into the disposer, it is merely brought down to the point where the ears 125 rest on the upper surface of the groove 52, and in this position, the stopper is not seated and water may freely pass between the ears 125 and around the lip 121 into the disposer.

Figure 8:
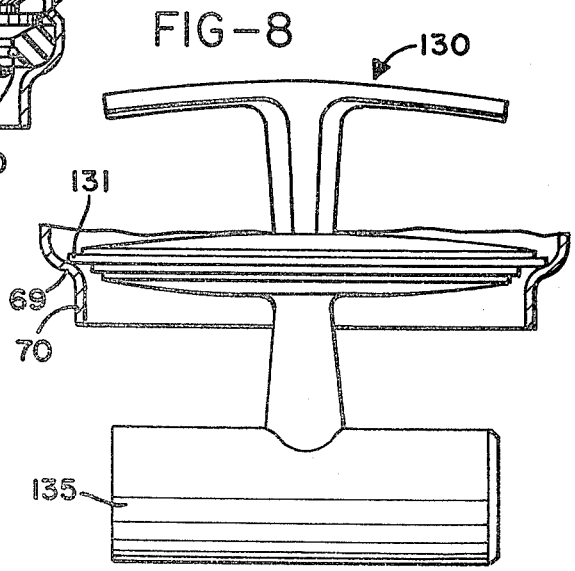
FIG. 8 is a section through the lower portion of the sink flange showing a stopper in place for use with a batch type disposer.

The sink flange 10 may be used for a batch type disposer and a magnetic stopper and actuator 130 is illustrated in FIG. 8. The stopper 130 has an annular lip 131 which, in this case, is proportioned to engage the sink flange at the flared portion 69 thereof just above the skirt 70 as shown in FIG. 8, to form a seat so that the sink may be filled with water. In the batch type disposer, the splash shield 100 is not used.

The stopper 130 includes a depending magnet actuator 135, which when lifted and rotated through 90° from the position shown, actuates a magnetically-operated switch in the manner disclosed in the Coss U.S. Pat. No. 2,619,654 issued Dec. 2, 1952 and now assigned to the same assignee as this invention. The magnet portion 135 thus extends downwardly into the neck 32 of the disposer but when it is rotated to the position in which it operates the disposer magnetic control switch, the stopper 130 is elevated somewhat above the portion 69 of the drain flange so that water may readily pass thereabout and into the disposer.

It may accordingly be appreciated that the apparatus herein described permits a substantial simplification in the installation of disposers to sinks. Once the sink flange has been inserted from the top, it is only necessary to bring the pressure plate 125 up and locate in on the proper set of bosses according to the type of sink. The installer may now simply lift the disposer into position to the point where the snap ring 50 drops into the groove 52, make his electrical and plumbing connections and proceed to turn the jack screws at the hex 68 until firm resistance is felt. At this point not only has the sink flange been drawn down firmly onto the sink and the pressure plate brought firmly underneath, the compression plate has automatically effected the forming of a water tight seal by the controlled compression of the seal 40 between the constricted region at the land 72 and the tapered throat portion 37. The added resistance is noted when the compression plate 60 has bottomed on the surface of the flared radial portion 34. The installation is now complete. If a continuous type disposer has been installed it is now a simple matter to insert the splash shield 100 and its reinforcing ring 110, if this has not previously been accomplished.

Removal is quite simply a reversal of the above procedure, that is, a retraction of the jack screws 65 and a slight lifting of the disposer and a spreading out of the ring 50 by pushing at the end 55. This releases the ring from the groove 52 by movement into the space 59. The disposer may now be lowered from the drain flange. However, if the disposer has been installed for a long period of time, it is possible that the seal 40 may have become adhered to the drain flange, and if this presents difficulty in disconnecting, the shoulder bolts 46 may be removed, permitting direct access to the seal 40 and permitting the disposer to drop away by separation along the outer surface of the seal and the disposer.

While the method herein described, and the form of apparatus for carrying this method into effect, constitute preferred embodiments of this invention, it is to be understood that the invention is not limited to this precise method and form of apparatus, and that changes may be made in either without departing from the scope of the invention.

What is claimed is:

1. A mounting assembly for attaching a food waste disposer to a sink, comprising a sink flange which is adapted to be inserted into the drain opening in the sink with a flared top overlying the drain opening and an enlongated neck extending through said opening below the sink, an annular pressure plate received on the said neck in underlying relation to said sink, cooperating interlocking means on said plate and neck engageable by rotation of said plate on said neck temporarily retaining said flange in assembled relation on the sink while providing for unrestricted movement of said plate upwardly against the bottom of the sink, annular groove means formed in said neck in spaced relation to said interlocking means, said disposer having an inlet adapted to be received telescopically over said flange neck, a ring retainer assembly on said disposer at said inlet having an annular snap ring engageable with said groove means upon lifting said disposer over said neck and providing for the self-holding of said disposer in suspended relation on said flange when released, said disposer being free to be rotated with respect to said flange while so suspended to provide for the making of electrical and drain connections, and jack screw means extending between said disposer and said pressure plate for lifting said pressure plate from said neck interlocking means against the bottom of the sink and securing said disposer and flange against rotational movement.

2. The assembly of claim 1 further comprising an annular seal in said disposer inlet engageable with said neck, said disposer having an annular compression plate resting on an exposed surface of said seal, said jack screw means being threaded into said compression plate and operable to force said compression plate downwardly onto said seal to compress said seal about said neck simultaneously with the lifting movement of said pressure plate against the bottom of the sink.

3. A mounting assembly for attaching a food waste disposer to a sink, comprising a sink flange adapted to be inserted into the drain opening of the sink having a flared top overlying the drain opening and having an elongated neck extending through said opening in underlying relation to the sink, means on said neck forming at least one set of annularly arranged, arcuately spaced protuberances positioned in spaced relation to the bottom of said sink, an annular pressure plate adapted to be received over said neck, said pressure plate being formed with a plurality of clearance openings permitting said plate to pass by said protuberances when said protuberances and openings are aligned, said protuberances being proportioned to engage said plate and to support it in loosely assembled relation on said neck under said sink when said plate is rotated so that said clearance openings and protuberances are not aligned, said plate capturing said flange and providing temporary support therefor on the sink permitting the axial engagement of a disposer thereon without the necessity for otherwise holding said sink flange, said plate being free on said neck to move axially off of said protuberances into pressure engagement with said sink for forming a seal thereon.

4. The mounting assembly of claim 3 in which said one set comprises a first set of protuberances at a first axial spacing from said flared top for supporting said pressure plate when mounting said flange in a sheet metal sink, and a second set of said protuberances spaced axially from said top a distance greater than said first set for supporting said pressure plate in mounting said flange in the opening of a cast iron sink.

5. A mounting assembly for attaching a food waste disposer to a sink, comprising a sink flange adapted to be inserted into the drain opening of the sink having a flared top overlying the drain opening and having an elongated neck extending through said opening in underlying relation to the sink, a set of three actuately spaced protuberances formed on said neck so as to be positioned in spaced relation to the bottom of said sink, an annular pressure plate adapted to be received on said neck, said pressure plate being formed with three correspondingly spaced clearance openings on its inside diameter, said openings being proportioned to permit said plate to pass by said protuberances, said protuberances being proportioned to engage said plate and to support it in loosely assembled relation on said neck under said sink when said plate is rotated to a position in which said clearance openings and protuberances are not in alignment, said plate providing temporary support for said flange on the sink permitting the axial engagement of a disposer thereon without the necessity for otherwise holding said sink flange, said plate being free on said neck to move axially off of said protuberances into pressure engagement with said sink for forming a seal thereon.

6. The mounting assembly of claim 5 further comprising a second set of three arcuately spaced protuberances on said neck, said second set being spaced axially from said flared top a distance greater than that of said first set, the spacing of said first set providing for the support of said pressure plate for the mounting of said flange in a sheet metal sink, and the greater spacing of said second set providing for the support of said pressure plate for the mounting of said flange in the opening of a cast iron sink.

7. A mounting and sealing assembly for attaching a waste food disposer to a sink, comprising a sink flange which is adapted to be inserted into the drain opening in the sink with a flared top overlying the drain opening and an elongated neck extending through said opening below the sink, an annular pressure plate received on said neck in underlying relation to said sink, cooperating interlocking means on said plate and neck engageable upon rotation of said pressure plate on said neck for temporarily retaining said flange in assembled relation on said sink while providing for unrestricted movement of said pressure plate upwardly against the bottom of the sink, annular groove means formed in said neck in spaced relation to said interlocking means, a ring retainer assembly on said disposer having a snap ring engageable with said groove upon lifting said disposer over said neck and providing for the self-holding of said disposer in suspended relation on said flange when released, said disposer being free to be rotated on said flange while so suspended to provide for the making of electrical and drain connections thereto, jack screw means extending between said disposer and said pressure plate for lifting said pressure plate against the bottom of the sink and locking said disposer on said sink flange and locking said flange with respect to the sink, means in said disposer forming an inwardly tapered throat, an annular flange seal received in said throat and adapted to engage the neck of said flange, an annular compression plate received on the upper surface of said seal, said jack screw means being threaded into said compression plate having upper ends engageable with said pressure plate and operable to force said compression plate downwardly against said seal to urge said seal inwardly of said throat into gripping relation with said neck simultaneously with the lifting of said pressure plate to lock said disposer in fixed relation to said sink and flange.

8. The assembly of claim 7 wherein said interlocking means includes cooperating recesses and protuberances respectively on said pressure plate and neck engageable by rotation of said pressure plate on said neck for temporarily retaining said flange in assembled relation on said sink while providing for unrestricted movement of said pressure plate upwardly against the bottom of the sink.

9. A food waste disposer assembly comprising a sink flange having a flared upper end and a tubular neck portion, said flange being receivable in a sink opening with said upper end on one side of the sink and with said neck portion extending therethrough and terminating beneath the sink, sealing means between said flared end and said sink, a food waste disposer having a tapered mouth portion received in telescopic relation to said flange neck portion, means rotatably suspending said disposer on said neck portion, a compressible gasket received between the disposer and flange in said tapered mouth portion and adjustable compression means acting between said sink and gasket applying equal and opposite axially outward forces thereto for mutually sealing said sealing means at said sink opening and said flange to disposer gasket fixing said disposer in the selected rotational position with respect to the sink flange.

10. The assembly of claim 9 further including an annular pressure plate surrounding said sink flange and movable between a first position wherein said flange and pressure plate are mutually captured on said sink and a second position wherein said adjustable compression means engages said annular pressure plate in acting against said sink.

11. Waste disposer mounting apparatus comprising a sink flange receivable in the drain opening of a sink including a sleeve portion insertable through said opening and an outwardly flared top larger than said opening and sealable with the inside sink bottom in response to force urging the flange flared top and sink bottom together, means engaging said sleeve portion axially below said sink, a disposer having a mouthpiece surrounding the lower part of said sleeve portion and defining an annular space therebetween, means for axially supporting said disposer mouthpiece from said axially engaging means while providing for substantial relative rotation between said disposer and sleeve portion, sealing means in said annular space deformable in response to axial compressive force thereon, and means expandable between the sink bottom and said sealing means applying equal action and reaction forces thereto for sealing flange-to-sink and flange-to-mouthpiece junctions.

12. The apparatus of claim 11 wherein said means for engaging said sleeve member includes a spring snap ring, and said means for axially supporting includes means mounting said snap ring on said disposer.

13. The apparatus of claim 11 wherein said disposer mouthpiece includes a flared mouth opening, said deformable means includes a compressible annular gasket of wedge-shaped cross section received between said flared mouth opening and said flange sleeve portion and said disposer further includes means responsive to said means expandable for compressing said gasket completely into said mouthpiece into a lateral sealing relationship with the sides of said flange and mouthpiece.

14. An improved sink flange for use in mounting a food waste disposer to either sheet metal or cast iron sinks, comprising a generally cylindrical elongated body which is adapted to be received in the drain opening of the sink having an outwardly flared top for engagement with the sink, annular means on said body adapted to receive and support a food waste disposer thereon and dividing said body into an upper cylindrical section and a lower cylindrical section, a first set of annularly arranged protuberances on said upper section of said flange body and spaced a first axial distance from said top providing temporary support for a pressure ring thereon in underlying relation to the sink to capture said drain flange in a sheet metal sink, and a second set of annularly arranged protuberances on said upper section and spaced from said top a second and greater axial distance than the spacing of said first set for supporting such pressure ring thereon in underlying relation to a cast iron sink.

15. Food waste disposer apparatus comprising a sink flange having a cylindrical body with an enlarged upper end, the flange being receivable in a sink opening with said enlarged upper end retained on the top side of the sink opening and with said cylindrical body extending through the sink; deformable means located between said enlarged end and said sink; a food waste disposer having a tapered mouth portion received over said flange body; means engaging said disposer with said flange body in any rotational alignment; a compressible gasket received within said tapered mouth portion surrounding said flange body and means expandable to develop internal compression force therein applying equal mutual opposed sealing force to said deformable sealing means and said compressible gasket while immobilizing the disposer with respect to the sink.

16. The mounting apparatus of claim 15 wherein said means engaging said disposer with said flange body includes a spring snap ring mounted on the disposer adjacent said tapered mouth portion at an annular groove defined in said flange cylindrical body for receiving said spring snap ring.

17. A food waste disposer assembly comprising a sink flange having a flared upper end and a tubular neck portion, said flange being adapted to be received in a sink opening with said flared end on one side of the sink and with said neck portion extending therethrough and terminating beneath the sink, sealing means between said flared end and said sink, a food waste disposer having a tapered mouth portion terminating in an arcuate ledge at the upper end thereof and received in telescopic relation on said flange neck portion, means rotatably suspending said disposer on said neck portion, a compressible gasket received in said tapered disposer mouth portion adjacent the sink flange therein, said gasket having a free portion exposed axially above said ledge, an annular compression plate received on the exposed free portion of said gasket and being movable to compress said gasket in response to compression means force, said ledge defining the maximum extent of compression movement of said plate, and adjustable compression means directing a force against the sink and against said compression plate for mutually sealing said sealing means at said sink opening and said gasket at said flange while the disposer is located in the selected rotational position with respect to the sink.

18. Waste disposer mounting apparatus comprising a sink flange receivable in the drain opening of a sink including a sleeve portion insertable through said opening and an outwardly flared top larger than said opening and sealable with the inside sink bottom in response to force urging the flange flared top and sink bottom together, means including a spring snap ring axially engaging said sleeve portion below said sink, a disposer having a mouthpiece surrounding the lower part of said sleeve portion and defining an annular space therebetween, means for axially supporting said disposer mouthpiece from said axial engaging means including an annular collar ring having a flared portion adjacent the innermost diameter thereof, said flared portion being of a first diameter at an axially extreme portion remote from the collar ring body and of a larger second diameter near the ring body to provide for positive capture and retention of said snap ring in said axially extreme portion and escape by expansion of said snap ring near said ring body, sealing means in said annular space deformable in response to axial compressive force thereon, and means expandable between the sink bottom and said sealing means to apply equal action and reaction forces thereto for sealing flange-to-sink and flange-to-mouthpiece junctions.

19. A sink flange for a waste food disposer comprising a generally cylindrical body portion receivable in the drain opening of a sink, an outwardly flared upper portion connected with said body portion and adapted for sealing with said sink drain opening, a set of circumferentially disposed protuberances located at a first axial position along said body portion and capable of bayonet engagement with an annular plate member, an inwardly flared lower portion connected with said body portion, a generally cylindrical downwardly extending skirt portion of smaller diameter than said body portion and connected with said body portion by said inwardly flared lower portion, means for supporting a disposer from said body portion, said skirt portion providing means for excluding waste from crevices between said sink flange and an attached disposer, said inwardly flared portion providing, on the exterior thereof, a camming surface capable of gradually expanding spring means received on said skirt portion during telescoping a disposer onto said body portion and, on the interior thereof, a seat for retaining a sink stopper.

20. The sink flange of claim 19 further including a second set of circumferentially disposed protuberances in a second axial position along said body portion for alternate engagement with said annular plate member.

21. Waste disposer mounting apparatus comprising a sink flange receivable in the drain opening of a sink and including a sleeve portion insertable through said opening and an outwardly flared top larger than said opening, means including a spring snap ring for gripping said sleeve portion below said sink in an axially rigid manner, a disposer having a mouthpiece surrounding the lower part of said sleeve portion and defining an annular space therewith, means for axially supporting said disposer mouthpiece from said means for gripping while providing for mutual rotation between said disposer and said flange and so that the sink flange can be oriented apart from the orientation of the disposer, deformable means in said space responsive to axial force adjacent said sleeve portion for sealing said sleeve portion and said disposer mouthpiece, means for applying axial force mutually to said sink flange flared portion and said deformable means; said means for axially supporting including an annular collar ring having a flared portion adjacent the innermost diameter thereof and wherein said flared portion is of a first diameter at the axially extreme portion thereof and of a larger second diameter near the ring body to allow positive capture and retention of said snap ring in said axially extreme portion and escape of said snap ring near said ring body, said means for supporting also including threaded screw members connecting said annular collar ring with said disposer mouthpiece, said screw members being removable for alternate demounting of a disposer from said flange.

22. Waste disposer mounting apparatus comprising a sink flange receivable in the drain opening of a sink and including a sleeve portion insertable through said opening and an outwardly flared top larger than said opening, means including a spring snap ring for gripping said sleeve portion below said sink in an axially rigid manner, a disposer having a mouthpiece surrounding the lower part of said sleeve portion and defining an annular space therewith, means for axially supporting said disposer mouthpiece from said means for gripping while providing for mutual rotation between said disposer and said flange and so that the sink flange can be oriented apart from the orientation of the disposer, deformable means in said space responsive to axial force adjacent said sleeve portion for sealing said sleeve portion and said disposer mouthpiece, means for applying axial force mutually to said sink flange flared portion and said deformable means; said means for axially supporting including an annular collar ring having a flared portion adjacent the innermost diameter thereof and wherein said flared portion is of a first diameter at the axially extreme portion thereof and of a larger second diameter near the ring body to allow positive capture and retention of said snap ring in said axially extreme portion and escape of said snap ring near said ring body, said means for supporting also including threaded screw members connecting said annular collar ring with said disposer mouthpiece, said screw members being removable for alternate demounting of a disposer from said flange and wherein one end of said spring snap ring is held rotationally captive by said annular collar ring.

* * * * *

UNITED STATES PATENT AND TRADEMARK OFFICE

CERTIFICATE OF CORRECTION

PATENT NO. : 3,982,703

DATED : September 28, 1976

INVENTOR(S) : Theodore F. Meyers

It is certified that error appears in the above-identified patent and that said Letters Patent are hereby corrected as shown below:

(56) References Cited: Patent "2,403,194" should be -- 2,903,194 --.

Column 1, line 57, "heck" should be -- neck --.

Column 4, line 16, "captured" should be -- capture --.

Column 5, line 31, after "bosses" insert -- being --;
line 68, "form or" should be -- form of --.

Column 7, line 35, after "stainless" insert -- steel --;
line 49, after "seal" insert -- 40 --; and
line 55, after "skirt" insert -- portion --.

Column 8, line 41, after "by" insert -- an --.

Claim 5, line 14, "actuately" should be -- arcuately --.

Claim 9, line 36, before "fixing" insert -- while --.

Signed and Sealed this

Seventeenth Day of May 1977

[SEAL]

*Attest:*

RUTH C. MASON
*Attesting Officer*

C. MARSHALL DANN
*Commissioner of Patents and Trademarks*